US010549976B2

(12) United States Patent
Valles et al.

(10) Patent No.: US 10,549,976 B2
(45) Date of Patent: Feb. 4, 2020

(54) POLYMERIC KEG CONNECTOR

(71) Applicant: Anheuser-Busch InBev S.A., Brussels (BE)

(72) Inventors: Vanessa Valles, Leuven (BE); Stijn Vandekerckhove, Leuven (BE)

(73) Assignee: Anheuser-Busch InBev S.A., Brussels (BE)

( * ) Notice: Subject to any disclaimer, the term of this patent is extended or adjusted under 35 U.S.C. 154(b) by 0 days.

(21) Appl. No.: 15/777,670

(22) PCT Filed: Nov. 22, 2016

(86) PCT No.: PCT/EP2016/078372
§ 371 (c)(1),
(2) Date: May 20, 2018

(87) PCT Pub. No.: WO2017/089324
PCT Pub. Date: Jun. 1, 2017

(65) Prior Publication Data

US 2018/0346311 A1 Dec. 6, 2018

(30) Foreign Application Priority Data

Nov. 26, 2015 (EP) ..... 15196504.3

(51) Int. Cl.
*B67D 1/08* (2006.01)
*B67D 1/04* (2006.01)

(52) U.S. Cl.
CPC ..... *B67D 1/0829* (2013.01); *B67D 1/04* (2013.01); *B67D 1/0462* (2013.01)

(58) Field of Classification Search
CPC ..... B67D 1/0829; B67D 1/04; B67D 1/0462
USPC ..... 222/80–86, 89, 394, 399, 400.7
See application file for complete search history.

(56) References Cited

U.S. PATENT DOCUMENTS 569,800 A * 10/1896 Post ..... B67D 1/0832 222/400.7
3,228,413 A 1/1966 Stevens, Jr.
3,374,927 A 3/1968 Schmidt
3,527,391 A 9/1970 DiMuria
3,905,522 A 9/1975 Johnston
4,089,444 A 5/1978 Shea
(Continued)

FOREIGN PATENT DOCUMENTS

CA 2012647 9/1990
EP 0 455 650 8/1990
(Continued)

*Primary Examiner* — Vishal Pancholi
(74) *Attorney, Agent, or Firm* — Levy & Grandinetti

(57) ABSTRACT

A polymeric keg connector for fluidly connecting the interior of a container has an opening with a fluid tube. The keg connector has a connector, a coupler, a support movable in a longitudinal direction Z with respect to the base body, a tube, and a penetration actuator. The distance the support is moved is sufficient for the tube penetration end to penetrate into the opening provided on a closure of the container. The sliding surfaces of the connector and the support are manufactured with a particulate-reinforced polymeric material and the polymeric material of the connector is reinforced by a particulate material that can be different from the particulate material reinforcing the support element.

8 Claims, 2 Drawing Sheets

(56) References Cited

U.S. PATENT DOCUMENTS

| | | | | |
|---|---|---|---|---|
| 4,699,298 | A | 10/1987 | Grant et al. | |
| 7,597,124 | B2 * | 10/2009 | Litto | B67D 1/0878 141/114 |
| 7,677,413 | B2 * | 3/2010 | Rahim | B65D 47/18 222/83 |
| 2002/0050498 | A1 * | 5/2002 | Celli | B67D 1/0839 222/400.7 |
| 2010/0181346 | A1 * | 7/2010 | Hanssen | B67D 1/0831 222/400.7 |
| 2014/0103066 | A1 * | 4/2014 | Geert Norbert | B67D 1/0418 222/95 |
| 2015/0266713 | A1 * | 9/2015 | Peirsman | B67D 1/0406 222/394 |

FOREIGN PATENT DOCUMENTS

| | | | |
|---|---|---|---|
| EP | 0 444 596 | 9/1991 | |
| EP | 2 146 832 | 10/2008 | |
| EP | 2 148 770 | 10/2008 | |
| EP | 2 148 771 | 10/2008 | |
| EP | 2 152 486 | 10/2008 | |
| EP | 2 152 494 | 10/2008 | |
| EP | 2 719 656 | 4/2014 | |
| EP | 2 730 537 | 5/2014 | |
| WO | WO 2009/090223 | 7/2009 | |
| WO | WO 2009/090224 | 7/2009 | |
| WO | WO 2010/031764 | 3/2010 | |
| WO | WO 2011/006212 | 1/2011 | |
| WO | WO 2012/004223 | 1/2012 | |
| WO | WO 2013/000932 | 1/2013 | |
| WO | WO-2014057099 A2 * | 4/2014 | B67D 1/0406 |

* cited by examiner

POLYMERIC KEG CONNECTOR

TECHNICAL FIELD

The present invention concerns a keg connector for connecting a dispensing tube and/or a pressurized gas tube to a keg, typically a beer keg, mounted in a dispensing appliance comprising a tap column. The present keg connector allows easy, reliable and reproducible connection to a beverage keg in a single movement of either a dispense tube in fluid communication with a tapping valve mounted in a tapping column; or a gas tube in fluid communication with a source of pressurized gas; or both.

BACKGROUND FOR THE INVENTION

Traditionally beer, cider and other fermented beverages are served in public houses, bars, and restaurants directly from a keg connected to a tapping column by a dispense tube. Dispensing of the beverage is driven by a source of pressurized gas in fluid communication with the interior of the keg by means of a gas tube, such as to raise the pressure inside the keg above atmospheric pressure and at a level sufficient for driving the beverage from the keg up to the tapping column via the dispense tube. Beverage flow is controlled by a tapping valve located at the top portion of the column.

The tapping principle remains the same for both traditional metal kegs wherein a propellant is introduced in the keg in direct contact with the beer and for bag-in-containers comprising an inner, collapsible bladder or bag containing the beverage to be dispensed, which is contained in an outer, more rigid container have been used. Recently, cost effective bag-in-containers have been developed allowing their extensive use in mass consumer goods such as beer kegs, cider kegs, and the like (cf. e.g., EP2146832, EP2148770, WO2010/031764, EP2152494, EP2152494, EP2152486, EP2152486, EP2148771).

Keg connectors for traditional metal kegs are known from EP0455650 comprising:

(a) a connector base body;

(b) coupling means for firmly and releasably coupling the keg connector to an opening of the container;

(c) a support element movable in a longitudinal direction Z with respect to the base body, said support element supporting:

(d) a tube comprising a penetration end extending along a longitudinal axis Z and an opposite end portion for connecting to a dispense tube or propellant tube;

(e) a penetration actuation means for reversibly moving by a given distance along the longitudinal axis, Z, the tube penetration end of said fluid connector, from a first retracted position, Z0, to a second connected position, Z2, wherein said distance is sufficient for the tube penetration end to penetrate into the opening provided on a closure of said container.

Contrary to traditional kegs, the dispense tube and gas tube in bag-in-containers need be connected to separate parts of the keg, the former in fluid communication with the interior of the inner bladder, and the latter with the headspace between the bladder and the outer container. Note that the use of a dispense sword is not mandatory with bag-in-container types of kegs, contrary to conventional kegs. To this effect, bag-in-container type of kegs are usually provided with a closure comprising two separate openings: a dispense opening in contact with the interior of the inner bladder and a gas opening in contact with the headspace between inner bladder and outer container. Examples of closures suitable for bag-in-container types of kegs are disclosed in WO2009/090224, WO2009/090223, WO2012004223. It is clear that with such design the traditional keg connectors discussed above cannot be used. CA2012647 proposes a simple solution by providing a bung provided with two openings with corresponding valves and coupling means for independently coupling a dispense tube and a gas tube. For example, snap fit connections as disclosed in EP0905044 can be used as coupling means. This solution has the inconvenient that each tube must be connected one after the other which is long and tedious and the tubes could be coupled to the wrong opening.

To simplify the coupling operation, WO201100621, EP0444596, U.S. Pat. Nos. 4,699,298, 4,089,444, 3,905,522, 3,527,391 and 3,228,413 propose keg connectors comprising a clamp ring provided with an inner screw thread mating an external screw thread provided in the keg neck or closure. As the clamp ring is being screwed tight, the dispense tip and gas tip of parallel and separate dispense and gas connecting means are driven down through the dispense opening and gas opening provided in the keg closure. The problem with threaded clamp rings is that one is never sure whether the keg connector is fully coupled to the keg or not and also that, since the penetration of the dispense tip and gas tip through the originally sealed dispensing opening and gas opening may require some force, the required force is not always easy to provide by a screwing movement in a generally uncomfortable position. The maximum leverage afforded by a screw type clamp ring is limited to the size of grasp of a human hand, i.e., ca 10-15 cm) which is quite insufficient for the levels of forces required.

U.S. Pat. No. 3,374,927 discloses a keg connector suitable for bag-in-containers, comprising a latch member provided with a handle allowing the keg connector to be coupled to the container. Once the keg connector is firmly coupled to the keg, the tips of dispense and gas connecting means are pressed down by hand to pierce corresponding sealed openings. Although the handle gives leverage which facilitates coupling of the connector, the manual pressing down of the dispense and gas connecting means remains uncomfortable.

EP2719656 discloses a keg connector which can be coupled very easily to bag-in-container type of kegs comprising an opening, the keg connector comprising:

(a) a connector base body;

(b) coupling means for firmly and releasable coupling the keg connector to the opening of the container;

(c) a support element movable in a longitudinal direction Z with respect to the base body, said support element supporting:

(d) a tube comprising a penetration end portion parallel to the longitudinal axis, Z, and suitable for penetrating into the opening;

(e) penetration actuation means for reversibly moving by a given distance along the longitudinal axis, Z, the support element and tube, upon movement of the support element when the base body is coupled to said opening, from a first retracted position, Z0, to a second connected position, Z2, wherein said distance is sufficient for the tube penetration end to penetrate into the opening provided on a closure of said container. A drawback of a connector as disclosed in EP2719656 is that upon extensive usage, the connector base body and support element tend to get clogged, rendering it difficult to couple or decouple the keg connector from a keg.

The present invention addresses the above problem and provides a keg connector that has the ease of use of a keg connector as disclosed in EP2719656, yet is suited for extensive use without loosing its functionality and user friendliness. This and other advantages of the present invention are presented in continuation.

SUMMARY OF THE INVENTION

The present invention concerns a polymeric keg connector for fluidly connecting the interior of a container with a fluid tube, the keg connector comprising:

(a) a connector base body;

(b) coupling means for firmly and releasably coupling the connector base body to the opening of the container;

(c) a support element movable in a longitudinal direction Z with respect to the base body, by sliding one sliding surface of the support element against one sliding surface of the main base body, said support element rigidly supporting:

(d) a tube comprising a penetration end portion parallel to the longitudinal axis, Z, and suitable for penetrating into said opening;

(e) penetration actuation means for reversibly moving by a given distance along the longitudinal axis, Z, the support element and tube, upon movement of the support element when the base body is coupled to said opening, from a first retracted position, Z0, to a second connected position, Z2, wherein said distance is sufficient for the said tube penetration end to penetrate into said opening provided on a closure of said container, characterized in that, the sliding surfaces of both said connector base body and said support element are manufactured in a particulate reinforced polymeric material and in that the polymeric material of the connector base body is reinforced by a particulate material that is different than the particulate material reinforcing the support element.

The particulate materials can either differ in geometry, composition or both.

The reinforcing material is preferably selected from the group comprising: glass fibres, carbon fibres, basalt fibres, lignin fibres, cellulose cellulosic fibres, polyester fibres or admixtures thereof.

Preferably the polymeric matrix material of the connector base and support element are selected from the group comprising: polyethylene, polypropylene, polyoxymethylene, polyester, polyvinylchloride, or admixtures thereof, whereby it is preferred that both the connector base and support element are manufactured in a same or different polymeric matrix material.

Most preferably the polymeric keg connector according to the present invention comprises a connector base manufactured in a glass fibre reinforced polyolefin and a support element manufactured in a carbon fibre reinforced polyolefin or vice versa.

DETAILED DESCRIPTION OF A PREFERRED EMBODIMENT

Figure 1:
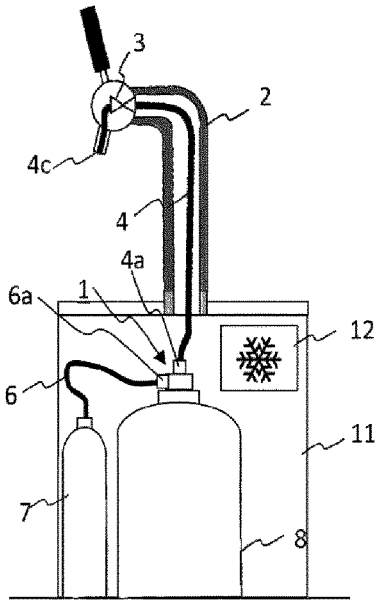
FIG. 1 schematically illustrates a keg connected to a tap column and a source of pressurized gas by a keg connector according to the present invention.

FIG. 1 illustrates a beverage dispensing device of the type comprising a keg (8) containing a liquid to be dispensed. The keg may be stored in a compartment (11) provided with refrigerating means (12) or, for example given, in a cellar of a pub. The keg is preferably a bag-in-container type of keg. The keg comprises an opening closed by a closure (88) provided with two openings: a dispense opening (44) suitable for bringing in fluid communication ambient atmosphere with the interior of the container, in particular the interior of the inner bladder containing the beverage for bag-in-container types of kegs, and a gas opening (66) suitable for bringing in fluid communication external atmosphere with the interior of the container, in particular the headspace comprised between the inner bladder and the outer container for bag-in-container types of kegs. The dispense opening (44) and possibly the gas opening (66) may be sealed prior to use with sealing element (44*a*, 66*a*). In the Figures, the seal is schematically represented by a straight line, but it is clear that it can have many geometries known in the art. The dispense and gas openings (44, 66) are preferably provided with sealing rings (not shown) for insuring a fluid tight contact with the dispense and gas tips (4*b*, 6*b*) when coupled to a keg connector (1).

The beverage dispensing device also comprises a source of pressurized gas (7) connected by a gas line (6) in fluid communication with the interior of the keg, in particular the headspace comprised between the inner bladder and the outer container for bag-in-container types of kegs. The source of pressurized gas (7) is used to increase the pressure inside the keg, above atmospheric pressure, in order to drive the flow of beverage through the dispense opening (44). A dispense line (4) coupled to the dispense opening (44) ensures fluid communication between the interior of the keg, in particular the interior of the inner bladder containing the beverage for bag-in-container types of kegs, and ambient atmosphere at its opposite end (4*c*). In order to control the flow of beverage out of the dispensing tube end (4*c*), the dispense line (4) is coupled to a tapping valve (3) located at the top portion of a tapping column (2) of any type commonly used in public houses, bars, and restaurants. The dispense line (4) and gas line (6) are coupled to the keg (8) by means of a particular keg connector (1) according to the present invention and described more in detail in continuation.

Figure 2:
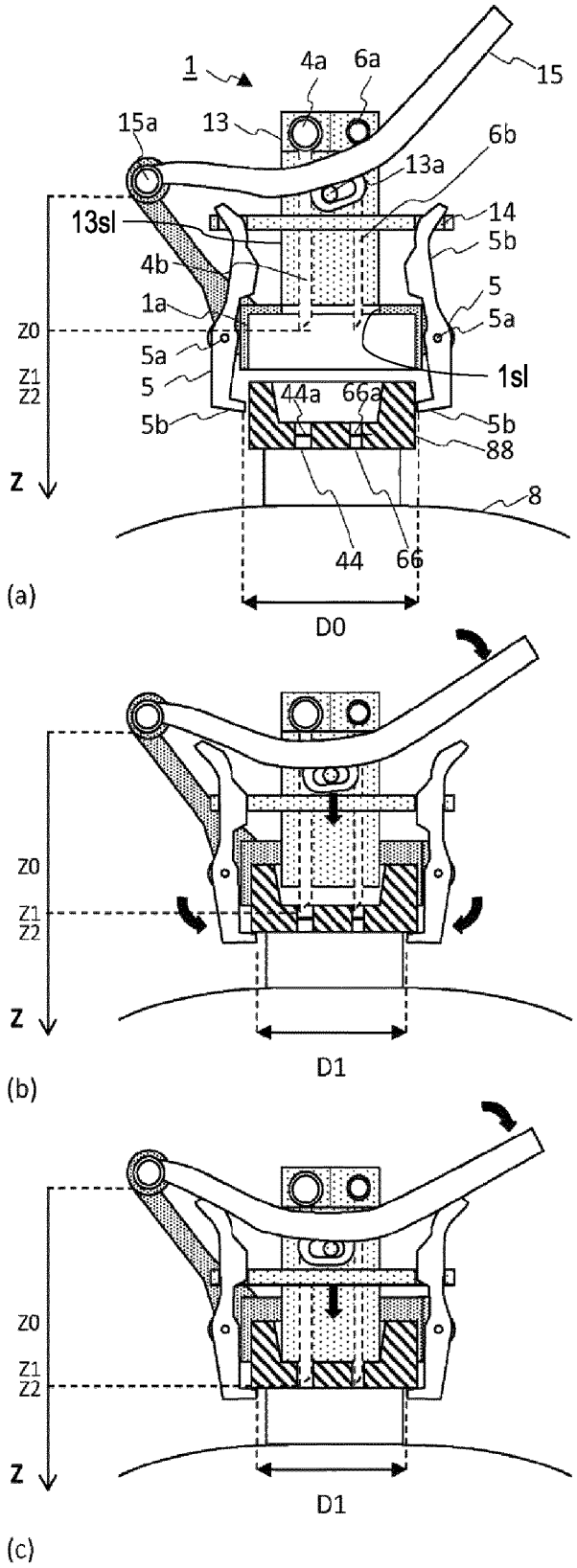
FIG. 2 illustrates a keg connector according to the present invention.

A keg connector according to the present invention is particularly suitable for connecting a dispense line (4) and/or gas line (6) to a bag-in-container type of keg in a very simple, easy, and reliable manner allowing extensive use and changing of kegs. FIG. 2 illustrates a preferred embodiment of a keg connector according to the present invention. The keg connector comprises a base body (1*a*) provided with an interface suitable for engaging the closure (88) of a keg (8). The various elements of the keg connector (1) are mounted on said base body (1*a*). Coupling means (5) are mounted on said base body (1*a*) for firmly and reversibly coupling the keg connector (1) to the neck (8*a*) of a keg (8) or to the closure (88) of said keg. The keg connector (1) receives a dispense connector (4*a*) and a gas connector (6*a*) which are connected to a dispense line (4) and gas line (6), respectively. A gas connector (6*a*) has similar geometry, and the features described with respect to the dispense connector (4*a*) apply mutatis mutandis to the gas connector (6*a*). The dispense and gas connectors (4*a*, 6*a*) each comprises a substantially straight dispense tube (4*b*, 6*b*) extending along a longitudinal axis, Z, and suitable for penetrating and, if it applies, piercing a dispense opening (44) and gas opening (66) of the closure (88) of the keg (8). The keg connector according to the present invention preferably comprises a single actuating means (15) allowing, with a single movement:

(a) To reversibly bring the coupling means (5) from an uncoupled to a coupled position, in which the keg connector is firmly coupled to the keg neck (8*a*) or keg closure (88), with the dispense tube (4*b*) and gas tube (6*b*) facing without penetrating corresponding dispense opening (44) and gas opening (66) provided on said keg closure; and (b) To reversibly move by a given distance along the longitudinal axis, Z, the dispense tube (4*b*) and gas tube (6*b*) from a first retracted position, Z0, to a second connected position, Z2, wherein said distance is sufficient for the dispense tube (4*b*) and gas tube (6*b*) to penetrate into the corresponding dispense opening (44) and gas opening (66) provided on the keg closure (88), and thus establish fluid communication with the interior of the container.

It is important that the coupling means (5) be in their coupled position before the dispense tube (4*b*) and gas tube (6*b*) have engaged the corresponding dispense and gas openings (44, 66) with any significant force to either tear open a seal or to force the passage through a resilient sealing ring (not shown). If this happened before the coupling means (5) were in their coupled position, the keg connector would risk to be disengaged from the keg neck (8*a*) or keg closure (88). For this reason it is preferable that, as the coupling means (5) reached their coupled position, the dispense tube (4*b*) and gas tube (6*b*) have moved along the longitudinal axis, Z, by an intermediate distance Z1<Z2, wherein said intermediate distance, Z1, is less than the distance required by the dispense tube (4*b*) and gas tube (6*b*) to penetrate through the corresponding dispense and gas openings (44, 66) of the keg's closure (88) for which the keg connector is designed. Thereafter, the coupling means maintain their coupled position, and the dispense and gas tubes (4*b*, 6*b*) continue their translation along the longitudinal direction, Z, from their intermediate position, Z1, to their connected position, Z2, to establish fluid communication with the interior of the keg.

In a preferred embodiment, the coupling means comprises a first and second latches (5) pivotally mounted on hinges (5*a*) disposed on opposite sides of the keg connector base body (1*a*), one free end of each of said latches ending in a protrusion (5*b*) extending towards each other. The protrusions (5*b*) have a geometry suitable for mating a surface of the keg neck they are designed for. Upon actuation of the single actuating means (15) the distance, D, separating the tips of each protrusion (5*b*) is varied from an uncoupled distance, D0, greater than at least one dimension of the keg's neck or keg's closure for which the keg connector is designed, such that the keg connector can be freely moved in the longitudinal direction, Z, until reaching its coupling position to said keg, to a coupled distance, D1<D0, smaller than a dimension of the keg's neck or keg's closure such that the keg connector is firmly fixed to said keg's neck or keg's closure.

According to the invention the dispense and/or gas connectors (4*a*, 6*a*) are supported on a support element (13) movable in the longitudinal direction, Z, with respect to the keg connector base body (1*a*). Said support element (13) is interconnected with each latch (5), such that by moving the support element (13) along the longitudinal direction, Z, from said retracted position, Z0, to said intermediate position, Z1, the latches (5) are driven to pivot about their respective hinges (5*a*) such that the distance between the tips of the latch protrusions (5*b*) is decreased from the uncoupled distance, D0, to the coupled distance, D1. Upon moving the support element (13) further along the longitudinal direction, Z, from said intermediate position, Z1, to said connected position, Z2, the distance between the tips of the latch protrusions remains substantially constant at their coupled distance value, D1.

The single actuating means (15) is preferably a lever, pivotally mounted on the base body (1*a*) of the keg connector with a hinge (15*a*). It is preferably interconnected with the support element (13) supporting the dispense and gas connectors (4*a*, 6*a*) such that pivoting the lever up or down about its hinge (15*a*) drives the support element up or down with respect to the base body (1*a*) along the longitudinal direction, Z, between its retracted position, Z0 and its coupled position, Z2, passing by its intermediate position, Z1. The connection between the lever (15) and the base body (1*a*) is preferably of the type of a pin (13*a*) engaged in a bean shaped slot, so that the rotational movement of the lever about its hinge (15*a*) can be translated into a rectilinear translation of the support element (13) along the Z-direction. Other connection types can be envisages, such as a hinged rod, as long as it permits to transmit a linear motion to the support element (13). Both the support element (13) and the base body (1*a*) comprise sliding surfaces (1*sl*, 13*sl*) sliding versus one another during the linear motion of the support element (13), these sliding surfaces can be executed as guiding means (not shown) such as rails, or mating protrusion/groove systems can be provided to guide along the longitudinal direction, Z, the translation of the support element with respect to the base body (1*a*). For structural strength of the keg connector, the base body (1*a*) defines a through channel that serves as a guide for the support element (13). The support element (13) and the base body (1*a*) sliding versus one another at their interface.

Designing the single actuation means as a lever is advantageous, because it allows the application of considerable forces with little efforts from an operator. This is important because, on the one hand, high forces may be required for the coupling because the keg is pressurized and tight sealing elements and coupling forces are required to maintain the system gas tight and, on the other hand, the operator is often in an uncomfortable position, crouched under the counter in often dark and noisy environments.

As explained supra, the rotational movement of the lever (15) about its hinge (15*a*) drives the linear movement along axis Z of the support element (13) with respect to the base body (1*a*) through the connection (13*a*) between them. In a preferred embodiment, the support element (13) is interconnected with the latches (5) such that the linear translation up and down along the longitudinal direction, Z, between the retracted position, Z0, and the intermediate position, Z1, of the support element (13) drives the pivoting of the latches (5) from their uncoupled position, D0, when the support element is at its retracted position, Z0, to its coupled position, D1, when the support element is at its intermediate position, Z1. The connection between the latches (5) and the support body (13) is also such that moving the latter along the Z-direction between its intermediate position, Z1, and its connected position, Z2, does not affect the position of the latches (5) anymore, which maintain their coupled configuration, D1.

The interconnection between the support element (13) and the latches (5) can be in the form of either:

(a) A curved sliding surface (5*b*) of the latches (5) engaged in corresponding openings (14) of the support element (13) (cf. FIG. 2), (b) A pin (13*p*) provided on the support element (13) engaged in an opening (14) in the shape of a curved bean slot provided on a latch (5) (cf. FIG. 3), or (c) A pin provided on a latch (5) engaged in an opening (14) in the shape of a curved bean slot provided on the support element (13) (not shown), The geometries of the bean shaped slots or sliding surfaces are such that the linear movement of the support element (13) with respect to the base body (1*a*) along the longitudinal axis, Z, generates the desired pivoting movement of the latches. For example, in the embodiments illustrated in FIGS. 2 and 3, each latch (5) is pivotally mounted on a hinge (5*a*) in its intermediate section comprised between the two ends thereof, thus defining:

(a) a first, lower latch section comprised between the hinge (5*a*) and the end provided with the protrusion (5*b*), and (b) a second, upper latch section comprised between the hinge (5*a*) and the latch second end.

Both the base body (1*a*) and the support element (13), at least at their sliding surfaces, are manufactured in a particulate reinforced polymeric material comprising a polymeric matrix material and a particulate reinforcing material. According to the present invention, the polymeric material of the base body (1*a*) is reinforced with a particulate reinforcing material different than the particulate reinforcing material reinforcing the polymeric material of the support element (13).

Under different particulate reinforcing material is to be understood that the particulate reinforcing materials of both the base body (1*a*) and the support element (13) differ in geometry (eg. spheres vs fibers) and/or composition (eg. glass vs carbon). By different reinforcing materials is meant that in at least one type of particulate reinforcing material present in the base body (1*a*) is not present in the support element (13) in an amount sufficient to structurally reinforce the support element (13) or vice versa.

Potential particulate reinforcing materials that can be used to reinforce the polymeric materials of the base body (1*a*) and the support element (13) comprise: glass fibres, glass spheres, carbon fibres (such as graphite fibres), carbon spheres, carbon plates, basalt fibres, lignin fibres, cellulosic fibres, polyester fibres and or mixtures thereof.

Both the base body (1*a*) and support element (13) are preferably manufactured in a polymeric composition having the same polymeric matrix material, the matrix material being selected from the group comprising: polyethylene, polypropylene, polyoxymethylene, polyester (eg. liquid crystal polymer), polyvinylchloride or admixtures thereof. However manufacturing both parts from polymeric compositions of different matrix materials is also possible. According to a preferred embodiment, the base body (1*a*) is manufactured in a (long) glass fibre reinforced polyoxymethylene and the support element (13) is manufactured in a graphite fibre reinforced liquid crystal polymer.

It is clear that both the base body (1*a*) and the support element (13) can each be coated at their interface with a polymeric composition having a different reinforcing material comprised therein.

In the embodiment of FIG. 2, the second, upper section of each latch (5) comprises a sliding surface (5*b*) having a specific curvature which is engaged in a slot (14) provided at appropriate positions on the support element (13) supporting the dispense and gas connectors (4*a*, 6*a*), such that as the support element (13) moves along the Z-direction, the slots (14) receiving the second portion of each latch (5) slide along the curved surface (5*b*) of the second upper portion of each latch. The slots (14) and the sliding surfaces (5*b*) have a geometry and dimensions such that as the support element (13) and slots (14) have moved with respect to the latches from the retracted position, Z0, to the intermediate position, Z1, the tip of the latch protrusions (5*b*) are brought closer together from an uncoupled distance, D0, to a coupled distance, D1. As illustrated in FIG. 2, the clamping of the latches is triggered by the slots (14) sliding along the first inner protrusion of the curved surface (5*b*) located between the positions of the slots (14) in FIGS. 2(*a*) and 2(*b*). The geometry of the curved surface (5*b*) must also be such that as the support element further moves down from the intermediate position, Z1, to the connected position, Z2, the latches (5) do not pivot anymore. This is easily achieved by providing a straight surface portion (5*b*) extending parallel to the Z-direction along which the slots (14) can run freely, as shown in FIG. 2(*b*)&(*c*)

The keg connector (1) of the present invention allows the fast and reliable connection to a keg (8) even under extensive use, with regular coupling and decoupling of the keg connector to different kegs, in particular to a bag-in-container kegs, of a dispense line (4) and a gas line (6). With a single move of the actuation means, in particular of a lever (15), the keg connector is firmly fixed to the keg neck (8*a*), preferably provided with a collar, or to the keg closure (88). This easy to use keg connector is particularly suitable for kegs which are stored under the counter with no easy access, or for specialty beers being stored in kegs of smaller dimensions which must be changed more often than large, e.g., 50 l kegs.

Figure 3:
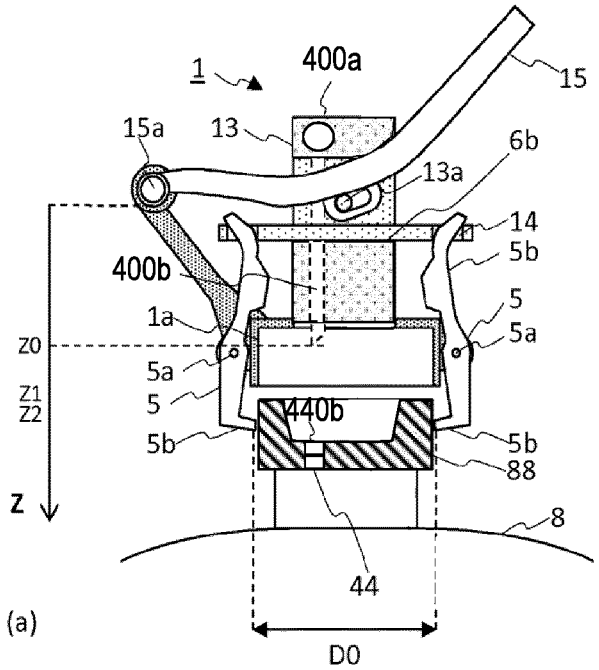
FIG. 3 illustrates a keg connector according to the present invention.

FIG. 3 represents an alternative embodiment of the keg connector according to the present invention, wherein the keg connector differs from the keg connector described in connection with FIGS. 1 and 2 in that it comprises only one connector (400*a*) and one tube (400*b*). Such keg connector according to the invention is suitable for application on kegs of the standard steel type, lacking an inner collapsible bladder or on kegs of the bag-in-container type wherein the propellant opening for introduction between the rigid outer container and collapsible inner bladder is located at an opposed side of the keg than the dispense opening. In such case the closure applied on the opening of the keg to interior to the flexible bladder comprises only one opening 440*b*.

The invention claimed is:

1. A polymeric keg connector for fluidly connecting the interior of a container comprising an opening with a fluid tube, the keg connector comprising:

(a) a connector base body;

(b) coupling means for firmly and releasably coupling the connector base body to the opening of the container;

(c) a support element movable in a longitudinal direction Z with respect to the base body, by sliding one sliding surface of the support element against one sliding surface of the main base body, said support element rigidly supporting:

(d) a tube comprising a penetration end portion parallel to the longitudinal axis, Z, and suitable for penetrating into said opening;

(e) penetration actuation means for reversibly moving by a given distance along the longitudinal axis, Z, the support element and tube, upon movement of the support element when the base body is coupled to said opening, from a first retracted position, Z0, to a second connected position, Z2, wherein said distance is sufficient for the said tube penetration end to penetrate into said opening provided on a closure of said container, characterized in that, the sliding surfaces of both said connector base body and said support element are manufactured in a particulate reinforced polymeric material and in that the polymeric material of the connector base body is reinforced by a particulate material that is different in geometry and/or composition from the particulate material reinforcing the support element.

2. The polymeric keg connector according to claim 1, the particulate material being selected from the group comprising: glass fibres, carbon fibres, basalt fibres, lignin fibres, cellulose fibres, polyester fibres or admixtures thereof.

3. The polymeric keg connector according to claim 1, the polymeric matrix material of the connector base and support element being selected from the group comprising: polyethylene, polypropylene, polyoxymethylene, polyester, polyvinylchloride or admixtures thereof.

4. The polymeric keg connector according to claim 1, the connector base and support element being manufactured in a same polymeric matrix material.

5. The polymeric keg connector according to claim 1, the connector base being manufactured in a glass fibre reinforced polyolefin and the support element being manufactured in a carbon fibre reinforced polyolefin or vice versa.

6. The polymeric keg connector according to claim 3, the connector base and support element being manufactured in a same polymeric matrix material.

7. The polymeric keg connector according to claim 2, the polymeric matrix material of the connector base and support element being selected from the group comprising: polyethylene, polypropylene, polyoxymethylene, polyester, polyvinylchloride or admixtures thereof.

8. The polymeric keg connector according to claim 7, the connector base being manufactured in a glass fibre reinforced polyolefin and the support element being manufactured in a carbon fibre reinforced polyolefin or vice versa.

* * * * *